US009204715B2

(12) United States Patent
Bonuccelli

(10) Patent No.: US 9,204,715 B2
(45) Date of Patent: Dec. 8, 2015

(54) ADJUSTABLE LEG FOR A TABLE

(71) Applicant: Unifor S.p.A., Turate, Como (IT)

(72) Inventor: Dante Bonuccelli, Turate (IT)

(73) Assignee: UniFor S.p.A., Turate (IT)

( * ) Notice: Subject to any disclaimer, the term of this patent is extended or adjusted under 35 U.S.C. 154(b) by 0 days.

(21) Appl. No.: 14/570,584

(22) Filed: Dec. 15, 2014

(65) Prior Publication Data

US 2015/0164218 A1 Jun. 18, 2015

(30) Foreign Application Priority Data

Dec. 16, 2013 (IT) ..... MI2013A2098

(51) Int. Cl.
*A47B 9/20* (2006.01)

(52) U.S. Cl.
CPC ..... *A47B 9/20* (2013.01)

(58) Field of Classification Search
CPC ..... A47B 9/20; A47B 2200/0054; F16B 7/14
USPC ..... 108/147.19, 148, 144.11; 248/188.5, 248/354.1
See application file for complete search history.

(56) References Cited

U.S. PATENT DOCUMENTS 3,537,762 A 11/1970 Lodige
3,887,155 A * 6/1975 Bertalot ..... 108/147.19
4,635,492 A * 1/1987 Uebelhart ..... 248/405
4,667,605 A * 5/1987 Bastian ..... 108/147.19
5,285,733 A * 2/1994 Waibel ..... 108/147.19
6,224,264 B1 * 5/2001 Bohm et al. ..... 384/220
6,345,547 B1 * 2/2002 Stoelinga et al. ..... 108/147
6,615,744 B1 * 9/2003 Eckstein et al. ..... 108/147.2
6,817,582 B2 * 11/2004 Wang ..... 248/188.5
6,843,183 B2 * 1/2005 Strong ..... 108/147.19
7,908,981 B2 * 3/2011 Agee ..... 108/147.19
2002/0050112 A1 * 5/2002 Koch et al. ..... 52/651.07
2003/0033963 A1 * 2/2003 Doyle ..... 108/147.19
2012/0043436 A1 * 2/2012 Atkinson ..... 248/188.5
2013/0221171 A1 * 8/2013 Lorenzen et al. ..... 248/188.5
2014/0360415 A1 * 12/2014 Riis et al. ..... 108/147.19
2015/0047538 A1 * 2/2015 Ergun et al. ..... 248/188.5

FOREIGN PATENT DOCUMENTS

DE 2 000 081 A1 7/1971
DE 20 2007 017 245 U1 4/2008
EP 2422647 A1 2/2012

* cited by examiner

*Primary Examiner* — Jose V Chen
(74) *Attorney, Agent, or Firm* — Dickstein Shapiro LLP

(57) ABSTRACT

An adjustable leg for supporting the top of a table. The adjustable leg includes a plurality of telescoping leg members in which the inner surface of one leg member faces and slides with respect to the outer surface of another leg member. Contrast members are provided between the inner surface of the one leg member and the outer surface of another leg member to form a forced coupling between the two leg members, to generate a static friction force therebetween, so that the static friction force opposes an outer longitudinal force applied to the second leg end towards the first leg end, to lock in rest the leg members to one another.

9 Claims, 14 Drawing Sheets

FIG. 16
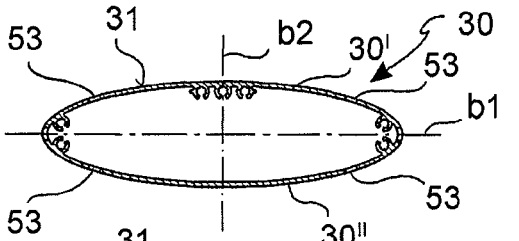
FIG. 17
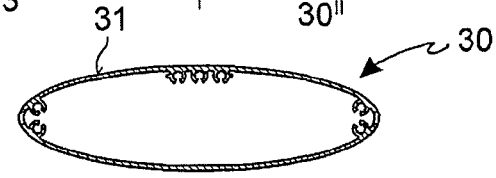
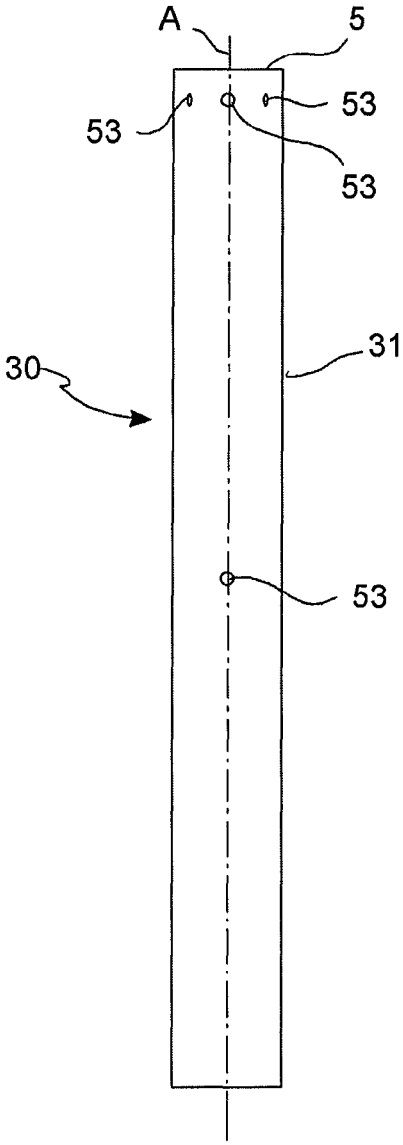
FIG. 18
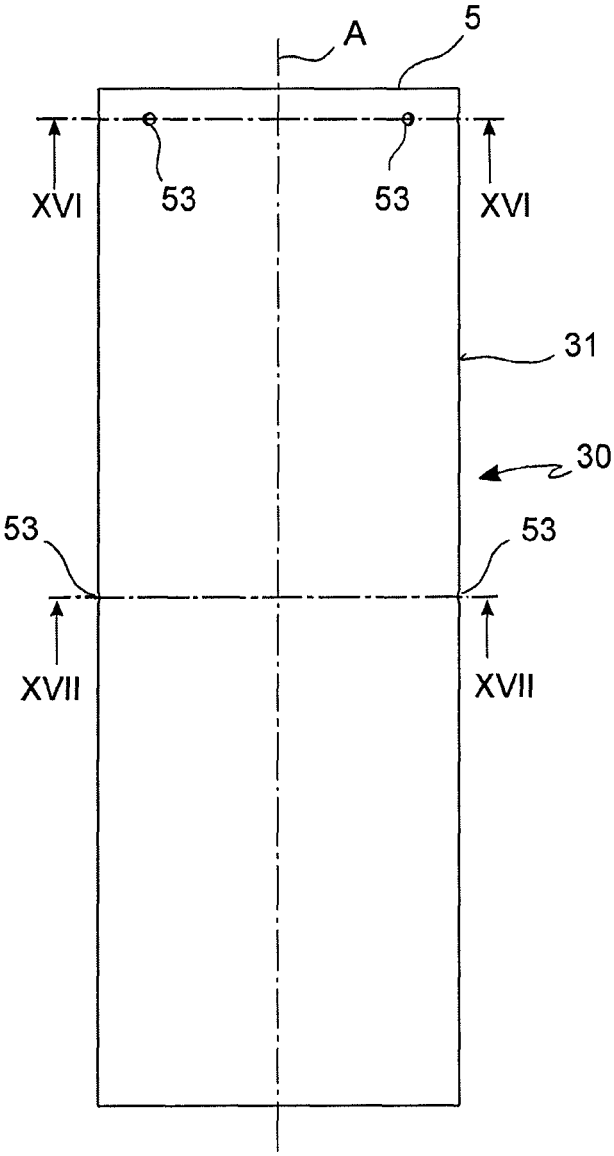
FIG. 19

FIG. 20
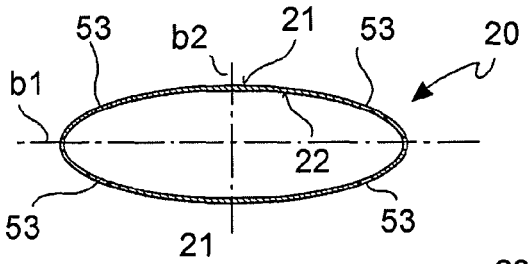
FIG. 21
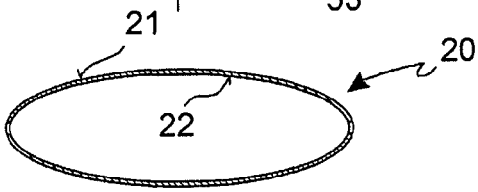
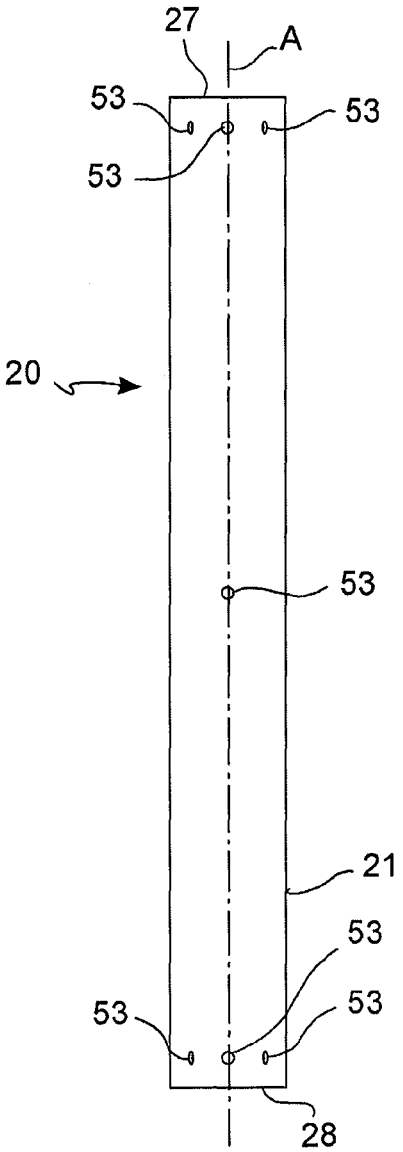
FIG. 22
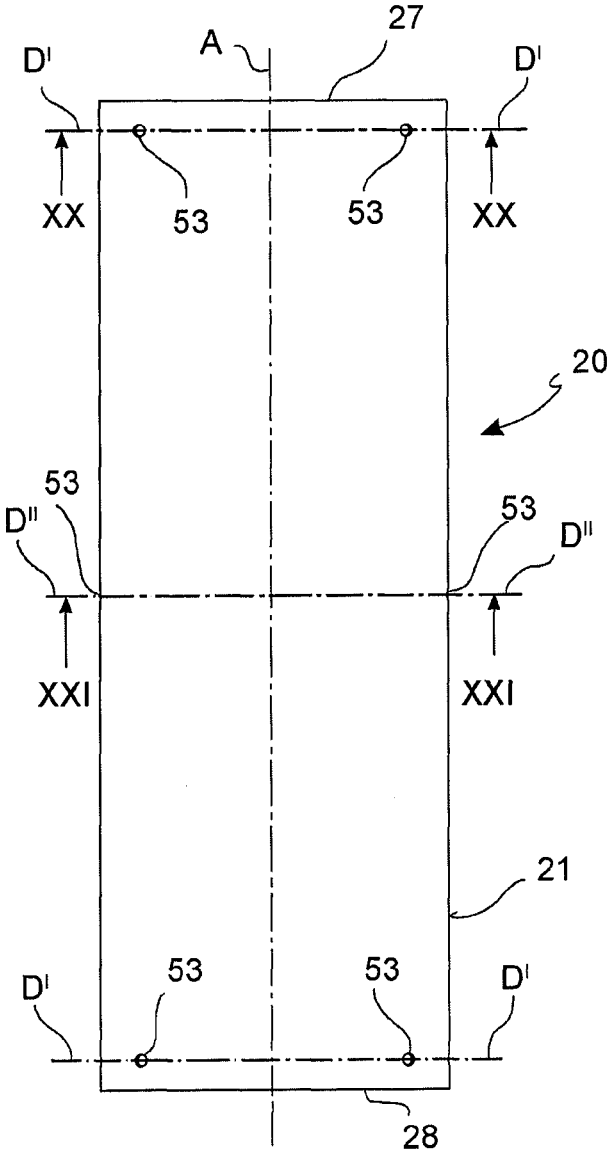
FIG. 23

FIG. 24
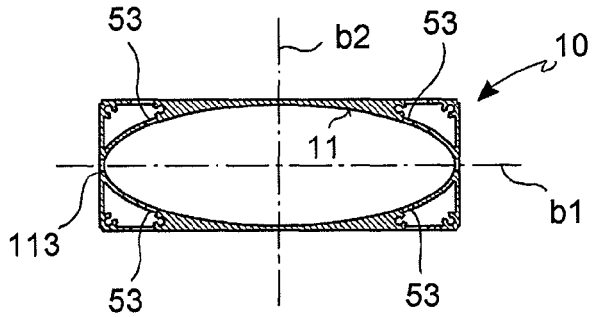
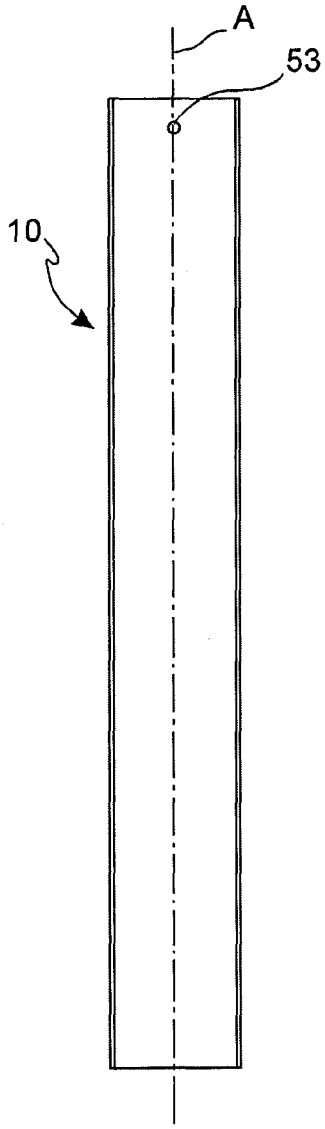
FIG. 25
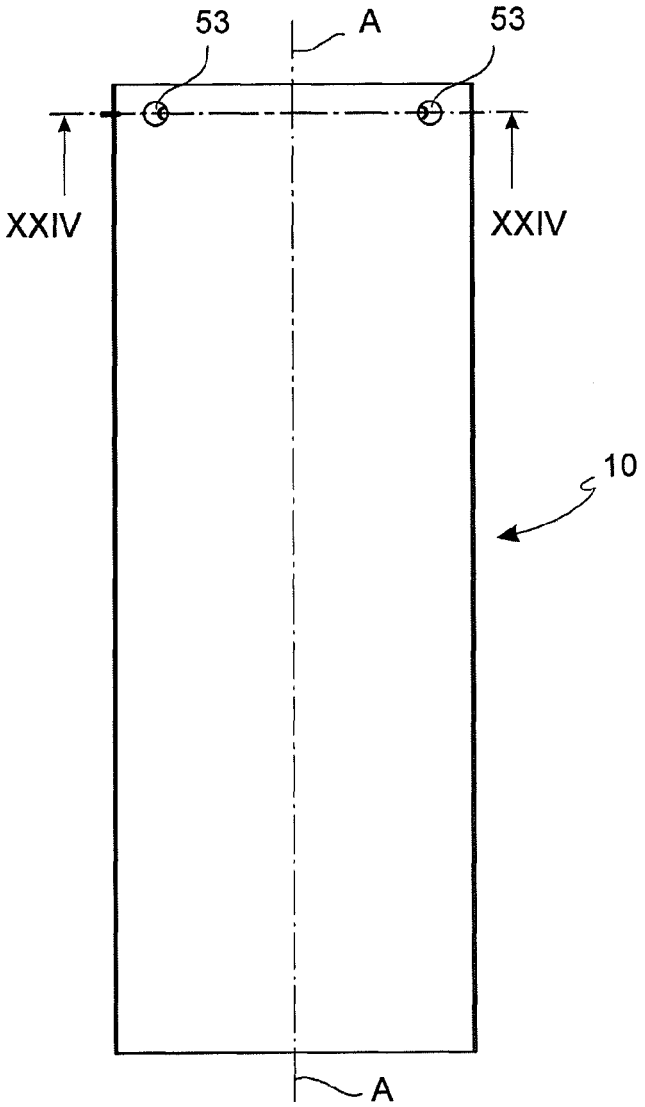
FIG. 26

ADJUSTABLE LEG FOR A TABLE

BACKGROUND OF THE INVENTION

1. Field of the Invention

The present invention relates to a height-adjustable leg suitable to support the work or the support surface of a table. The present invention further relates to a table having at least one height-adjustable leg.

2. Description of the Related Art

In the furnishing and in particular the table manufacturing industry, the technique of using support legs for a table which are adjustable in height so as to position and block the support surface at a desired height from the floor is well known.

In particular, telescopic legs exist extending along an axis of elongation generally substantially vertical, in particular formed of several reciprocally sliding segments or members which fit inside each other.

Such known telescopic legs require the use of precise sliding guides and carriages, which for aesthetic reasons must be hidden inside the members, which further complicates the structural complexity.

Such guide rails and carriages for the known legs are designed to minimize the sliding friction between the leg members. To do this a minimum clearance is often generated between the mechanical components which form the coupling between the various leg members, to facilitate sliding. Such minimal clearance produces the disadvantage of allowing a minimum relative displacement between the leg members outside the axis of elongation, producing a feeling of instability and poor quality construction, as well as potentially causing vibrations.

Among other things, when the known telescopic leg is formed of more than two members, and therefore at least one intermediate member is present between them, the problem of moving such member in synchrony with the relative movement between the end members arises. This often requires complicated mechanisms for transmitting the movement of such intermediate members according to the movement of the upper end with respect to the base end. These mechanisms are often quite complex and require belt drives, pulleys, etc. Furthermore the need to conceal these mechanisms inside the leg greatly complicates the manufacturing complexity and number of components required.

Moreover, these known adjustable legs, since designed to reduce or possibly eliminate the sliding friction between the leg members, do not provide in themselves, any structural support capacity in the direction of elongation or extension of the leg.

Thus the structural support action of such known legs is exclusively entrusted to additional structural members, sometimes formed of a linear actuator, such as a screw-and-nut system positioned parallel to the elongation axis of the leg, which connects at least the base member and the upper member of the adjustable leg to each other.

According to the prior art, therefore, all the weight of the table top and of the objects placed on it, but also the weight of the leg members, weigh exclusively on the linear actuator.

Since all the weight rests exclusively on the actuator, it must be oversized to ensure sufficient structural stability of the table when the support surface is stopped at a predetermined height, and also to ensure safe use to prevent unintentional lowering of the table top.

The greatly reduced spaces inside the leg for housing the actuator do not permit the use of sufficiently sturdy linear actuators to overcome this problem.

These limits of reduced structural stability and possible minimum displacements between the segments forming the known telescopic leg which conceals within it actuators and guide systems of said segments, makes it impossible to use a single known telescopic leg to support the support surface of a table, since such support surface would not be rigidly supported by the singe support leg, and would give the user an unpleasant sensation of poor quality construction and reduced safety of use.

The above limits of reduced structural stability and possible minimum displacements between the segments forming the known telescopic leg make the application of a single, known telescopic leg to support the support surface of a table, supporting it in a decentralized position, i.e. supporting a cantilever table top, even more unthinkable.

Such latter requirement to support the table top by means of a single leg in the vicinity of an edge of the table, not satisfied by the prior art, is particularly felt for both aesthetic and functional reasons, in fact, such a solution would provide both a linear and minimalist aesthetic effect, and convenience of use, leaving all the space below the table top free for the user's legs.

SUMMARY OF THE INVENTION

The purpose of the present invention is to excogitate and make available an adjustable leg for a table which makes it possible to satisfy the above needs and at least partially overcome the drawbacks mentioned above with reference to the prior art.

In particular, the task of the present invention is to provide a telescopic leg adjustable in height for a table, which is structurally very robust and stable and which at the same time, is structurally simple avoiding the need for a large number of components.

Another purpose of the present invention is to provide a telescopic leg adjustable in height for a table, able to maintain its position in height firmly and rigidly when the table top is placed at a desired height, avoiding relative displacements and vibrations between the leg members.

A further purpose of the present invention is to make available a telescopic leg which makes it possible to contain entirely inside it all the actuation components which permit the elongation/shortening movement of the leg.

Another purpose of the present invention is to provide a height-adjustable leg suitable to be operated in a smoothly sliding, quiet and safe manner avoiding sticking and vibrations.

Yet another purpose of the present invention is to provide a telescopic leg for supporting a table, suitable to be used as a single unit to fully support the cantilever table top, near an edge of the table top.

These and further purposes and advantages are achieved by means of an adjustable leg according to claim 1.

Such an adjustable leg allows extremely precise sliding between the leg members, or segments, without clearance, thus preventing any relative displacement between said leg members, apart from the sliding movement along the extension axis.

In fact, the contrast members interposed in elastic contrast between the outer surface of a leg member and the inner surface of a contiguous leg member eliminate any clearance between the leg members, providing a remarkable precision of sliding and structural strength.

Furthermore, the friction force which is generated between two adjacent members, through the interaction with the contrast members, makes it possible to transfer and distribute to all the leg members, a force applied to the second or upper end, towards the first or lower end of the leg, for example the weight force applied by the table top to the leg along the extension axis thereof. In other words, the presence of the contrast members and of the forced coupling generated thereby, gives the adjustable leg a structural capacity able to counter a compression force between the ends along the extension axis.

In the case in which a linear actuator is fitted in the telescopic leg to reciprocally move the ends of the adjustable leg, the structural action generated by the presence of the contrast members contributes to reciprocally block the leg members in a desired position, helping to reduce the holding force that weighs on the linear actuator.

In yet other words, indicating with "P" the weight force applied to the second or upper end of the leg, with "C" the holding force which the actuator has to exert against the weight force P, and with "F" the friction force generated by the contrast members, the holding force C which the actuator must exert to keep the table locked at the desired height is given by the weight force P, which the friction force F is subtracted from. It is thus sufficient to use an actuator capable of applying a holding force less than that which it would have to exert if the action of static friction generated by the contrast members of the present invention were not present.

This makes it possible to use an actuator of smaller dimensions easily housed inside the adjustable leg.

Moreover, the presence of the contrast members makes it possible to pull the intermediate members by mere friction, avoiding the need for bulky and complex movement mechanisms thereof.

BRIEF DESCRIPTION OF THE DRAWINGS

Further characteristics and advantages of the present invention will, in any case, be evident from the description given below of its preferred embodiments, made by way of a non-limiting example with reference to the appended drawings, wherein:

FIGS. 16 and 17 show cross-sections, orthogonal to the extension axis, of the upper end leg member taken respectively, through the cross-section planes XVI and XVII orthogonal to the extension axis;

FIG. 18 shows a side view of the upper end of the leg member, in the direction orthogonal to the extension axis and in the direction of the major axis of the transversal cross-section;

FIG. 19 shows a side view of the upper end leg member, in the direction of the minor axis of the transversal cross-section;

FIGS. 20 and 21 show cross sections, orthogonal to the extension axis, of a central leg member, taken respectively through the cross-section planes XX and XXI, orthogonal to the extension axis;

FIG. 22 shows a side view of said central leg member, in the direction orthogonal to the extension axis and in the direction of the major axis of the transversal cross-section;

FIG. 23 shows a side view of said central leg member, in the direction of the minor axis of the transversal cross-section;

FIG. 24 shows a transversal cross-section through a plane XXIV orthogonal to the extension axis, of a lower end leg member of the in FIG. 4;

FIG. 25 shows a side view of said lower end leg member, in the direction orthogonal to the extension axis and in the direction of the major axis of the transversal cross-section;

FIG. 26 shows a side view of the lower end of the leg member, in the direction of the minor axis of the elliptical transversal cross-section;

DETAILED DESCRIPTION OF THE PREFERRED EMBODIMENTS

Figure 1:
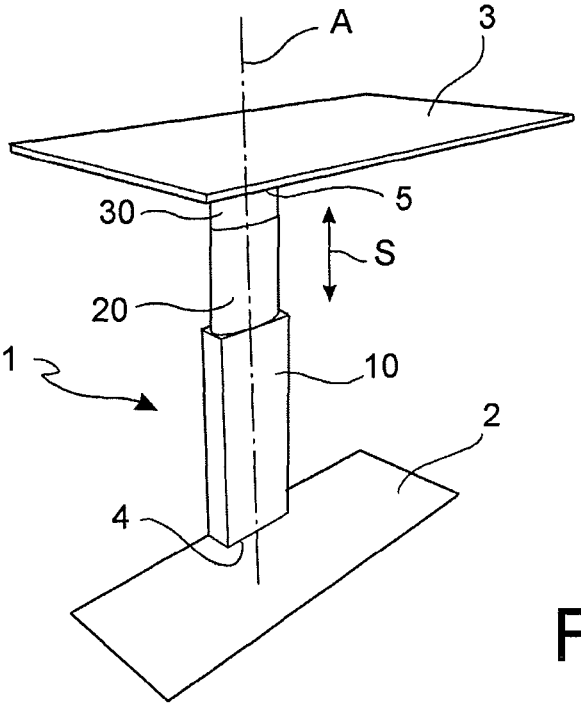
FIG. 1 shows a perspective view of a possible application of an adjustable leg according to the invention for supporting a height-adjustable table.
Figure 2:
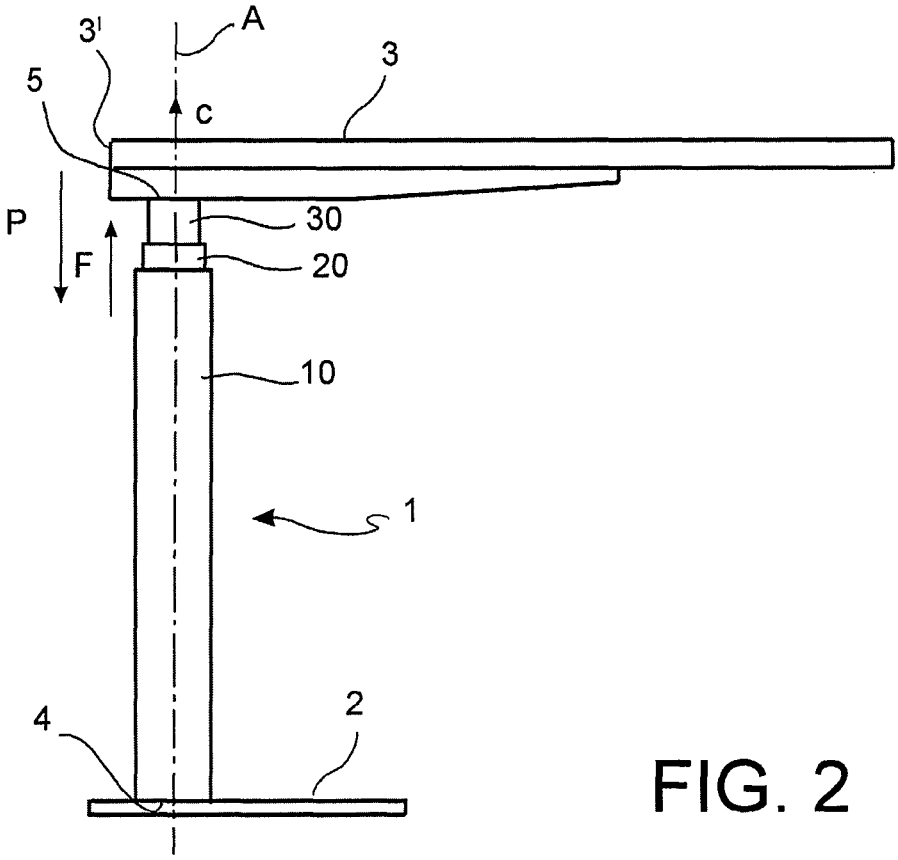
FIG. 2 shows a side view of the table and of the adjustable leg in FIG. 1.
Figure 3:
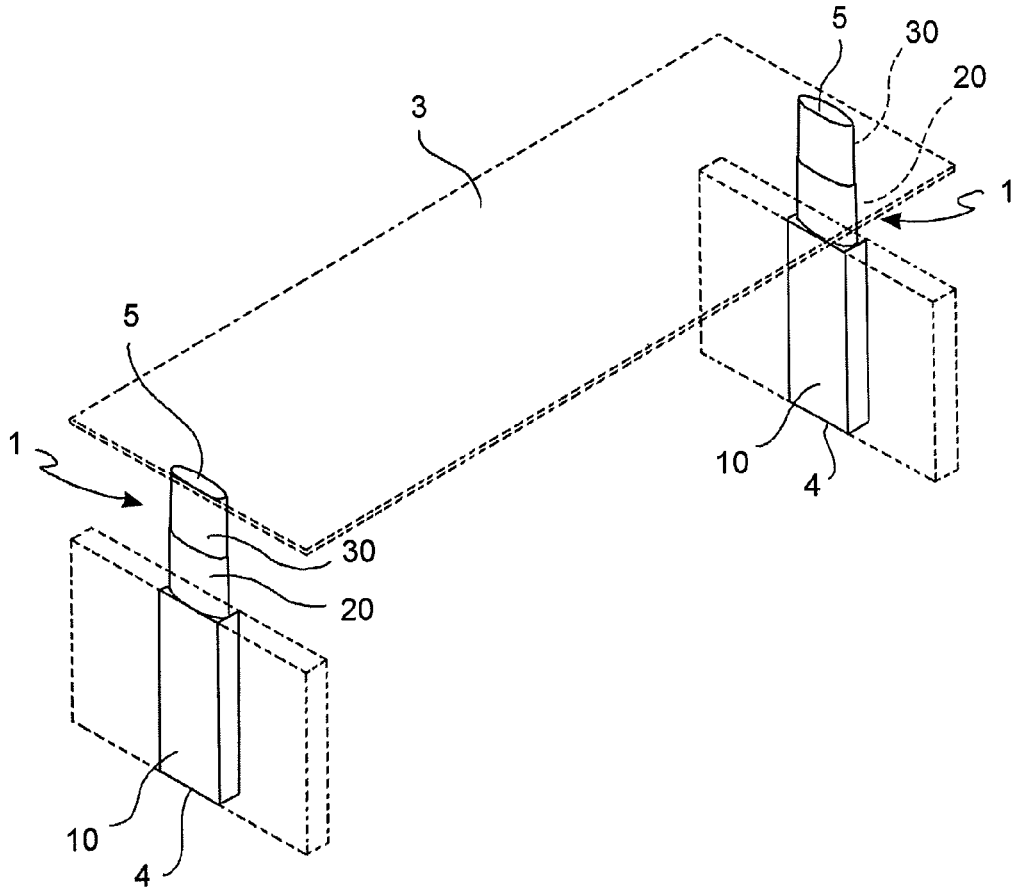
FIG. 3 shows a perspective view of a further embodiment of a table comprising a pair of adjustable legs according to the invention.
Figure 4:
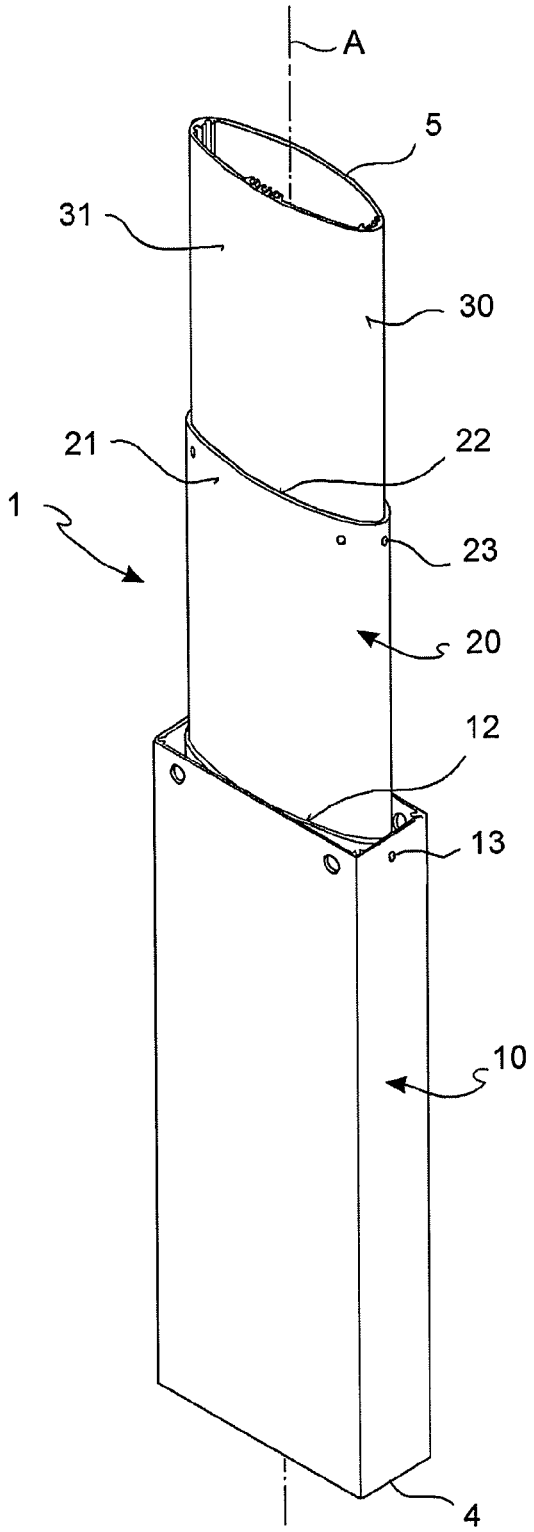
FIG. 4 shows a perspective view of an adjustable leg according to the invention, having an elliptical cross-section, shown in the extended or raised position.
Figure 5:
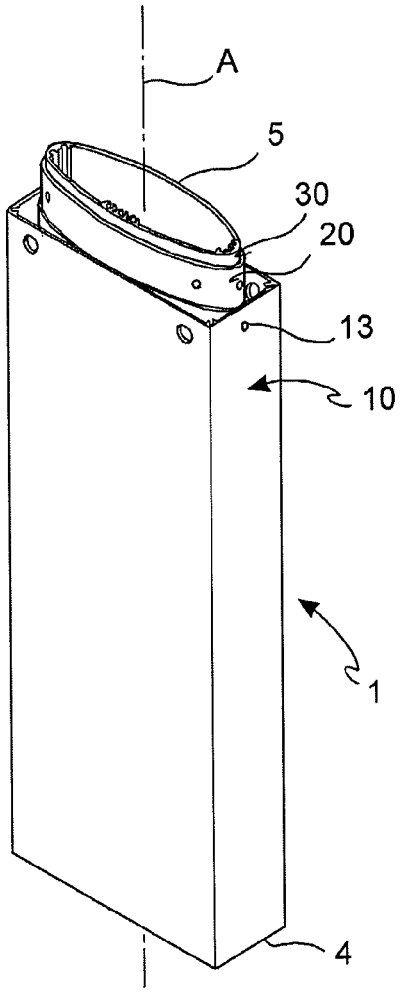
FIG. 5 shows a perspective view of the leg in FIG. 4, in which it is shown in the retracted or lowered position.
Figure 6:
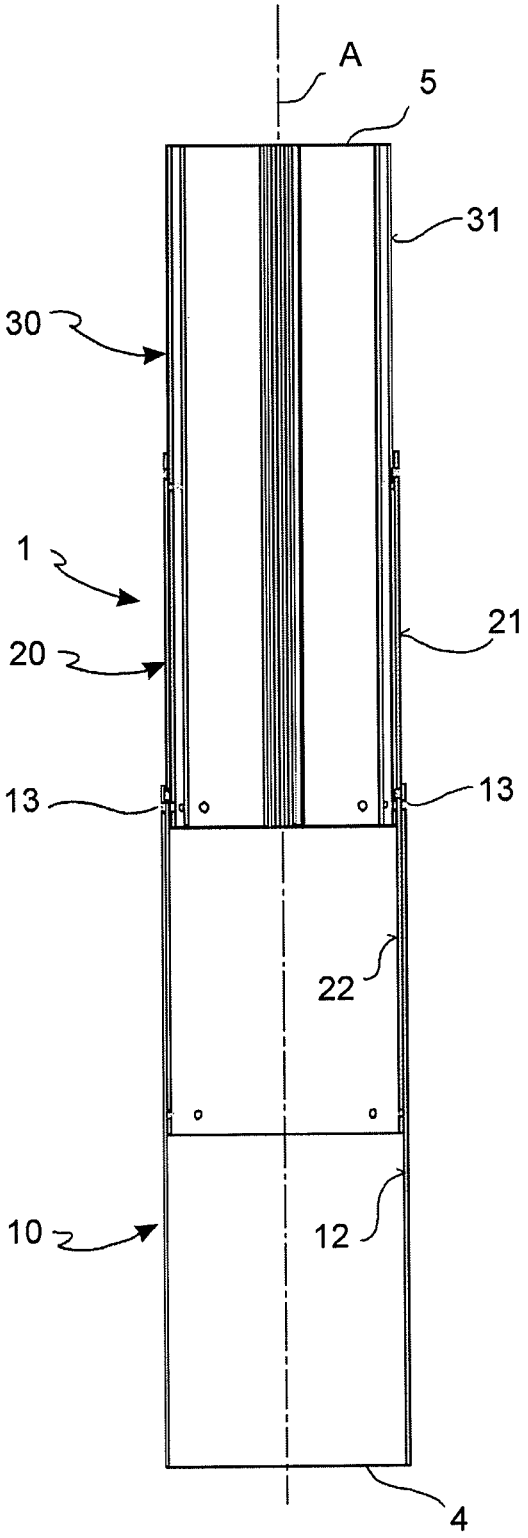
FIG. 6 shows a cross-section view of the leg in FIG. 4, with a longitudinal section plane VI passing through the extension axis of the leg and the major axis of the elliptical transversal cross-section, in which the leg is in the extended position.
Figure 7:
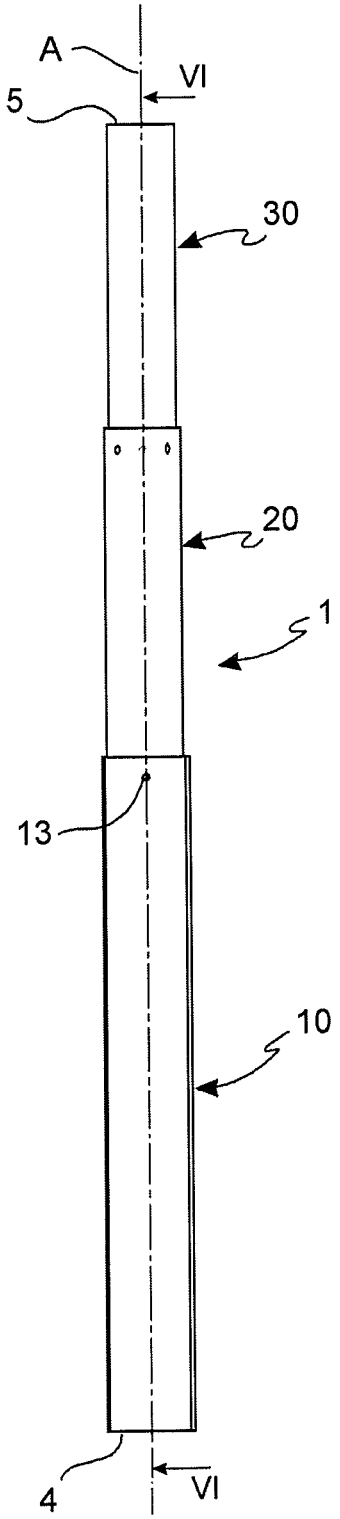
FIG. 7 shows a side view of the leg in the extended position, in the direction orthogonal to the axis and in the direction parallel to the major axis of the elliptical transversal cross-section of the leg.
Figure 8:
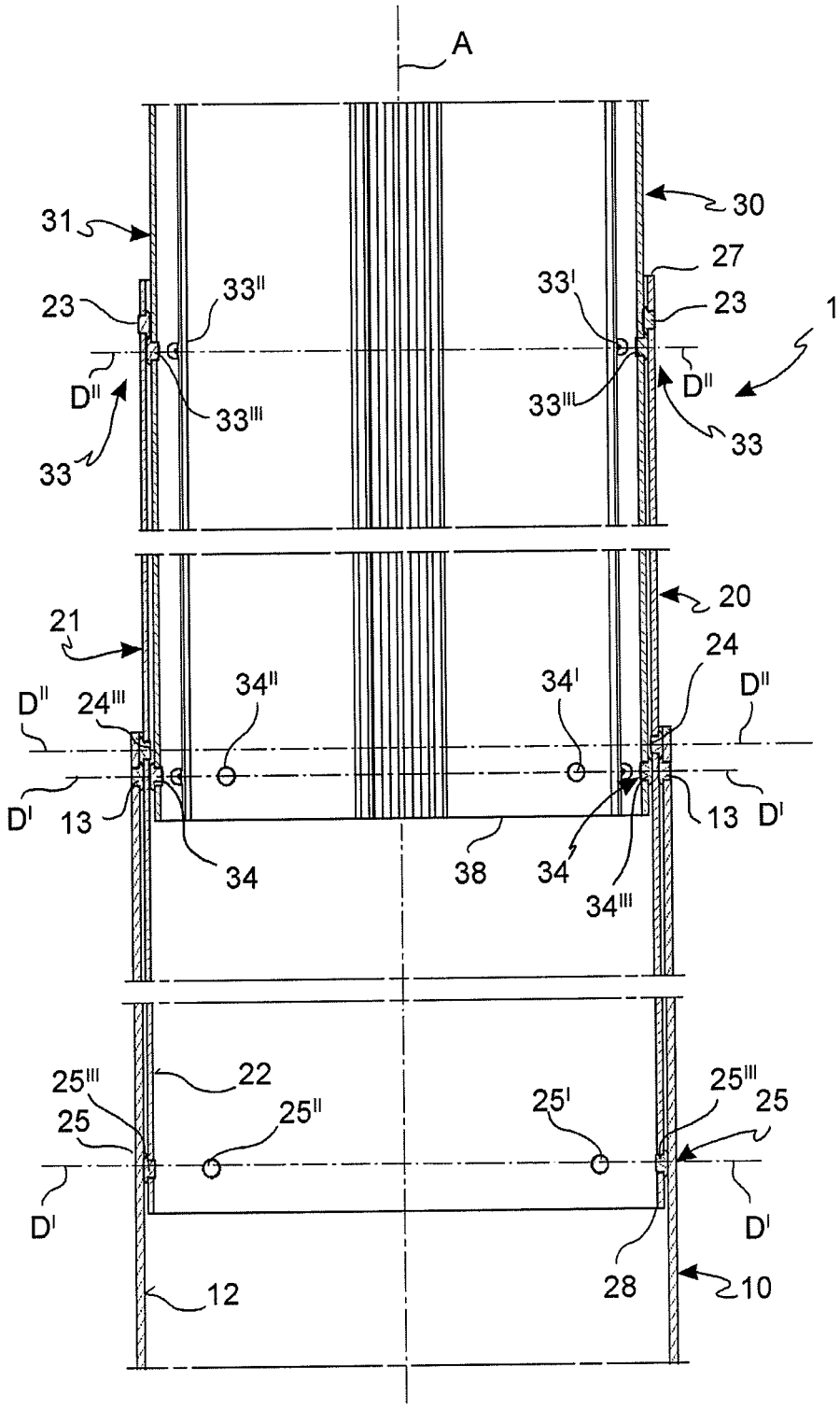
FIG. 8 shows an enlarged detail of the cross-section in FIG. 6, in which intermediate portions of the leg portions have been removed for reasons of simplicity of illustration.
Figure 9:
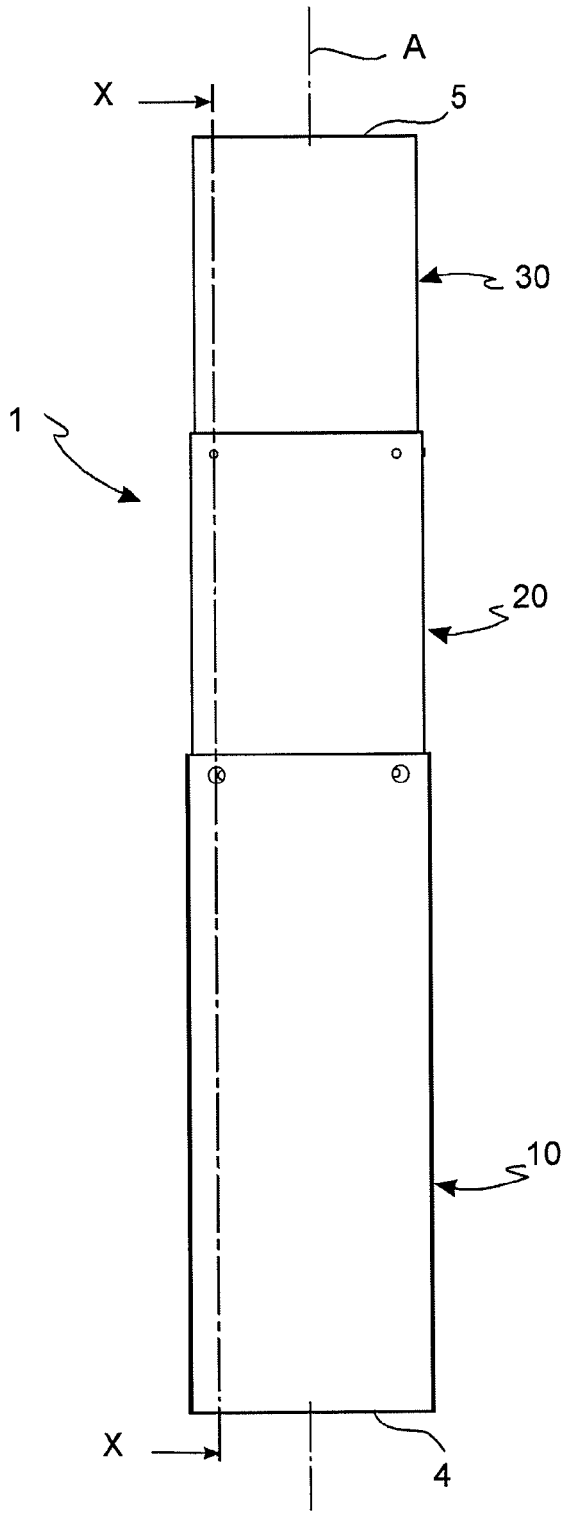
FIG. 9 shows a side view of the leg in elliptical transversal cross-section in FIG. 4, in the direction orthogonal to the extension axis and in the direction parallel to the minor axis of the elliptical transversal cross-section of the leg.
Figure 10:
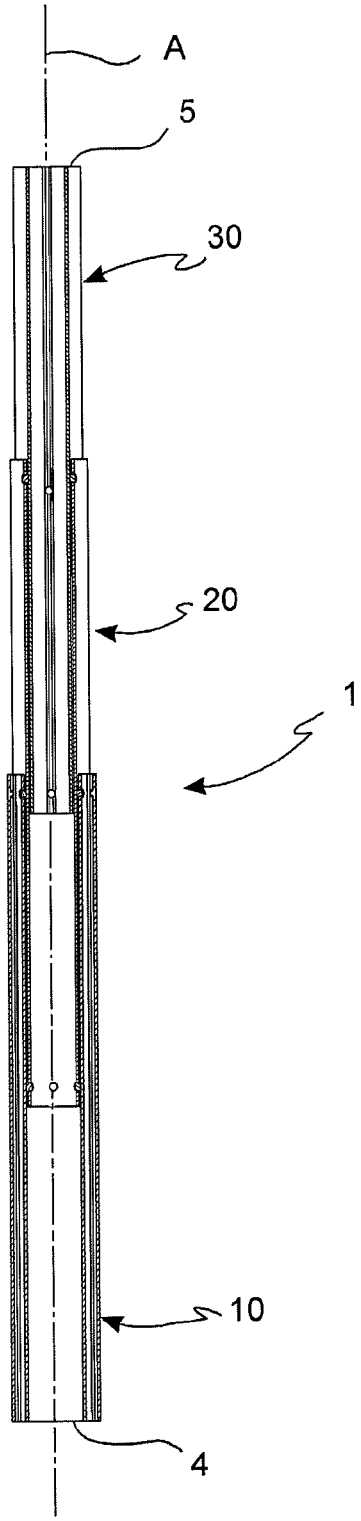
FIG. 10 shows a cross-section with a plane X of longitudinal cross-section of the leg in FIG. 4, in which said plane is parallel to the extension axis of the leg and parallel to the minor axis of the elliptical cross-section of the leg, wherein such plane passes at the point of the pulling members interposed between the leg members.
Figure 11:
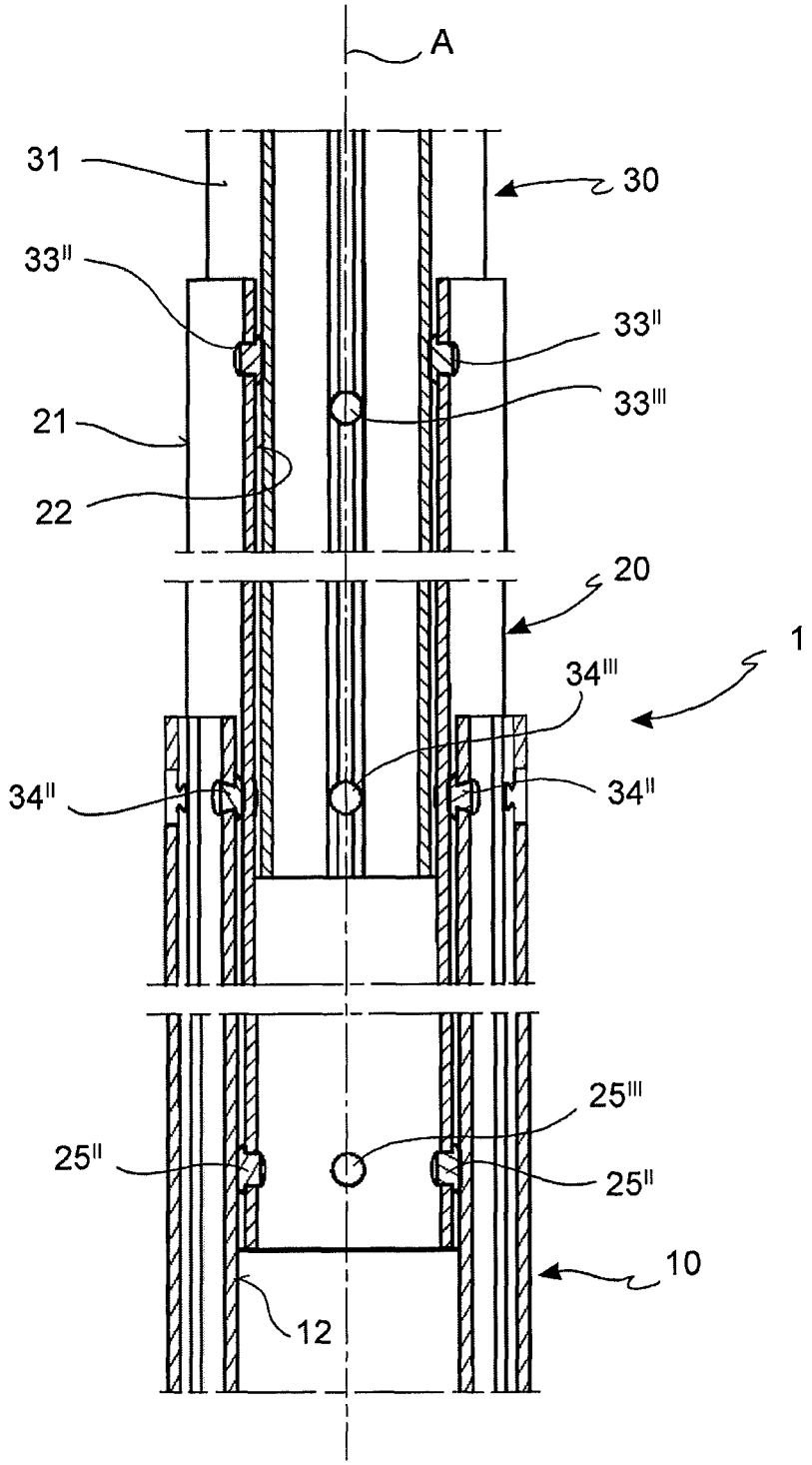
FIG. 11 shows an enlarged detail of the cross-section in FIG. 10 in which the intermediate portions of the leg portions have been removed for reasons of simplicity of illustration.
Figure 12:
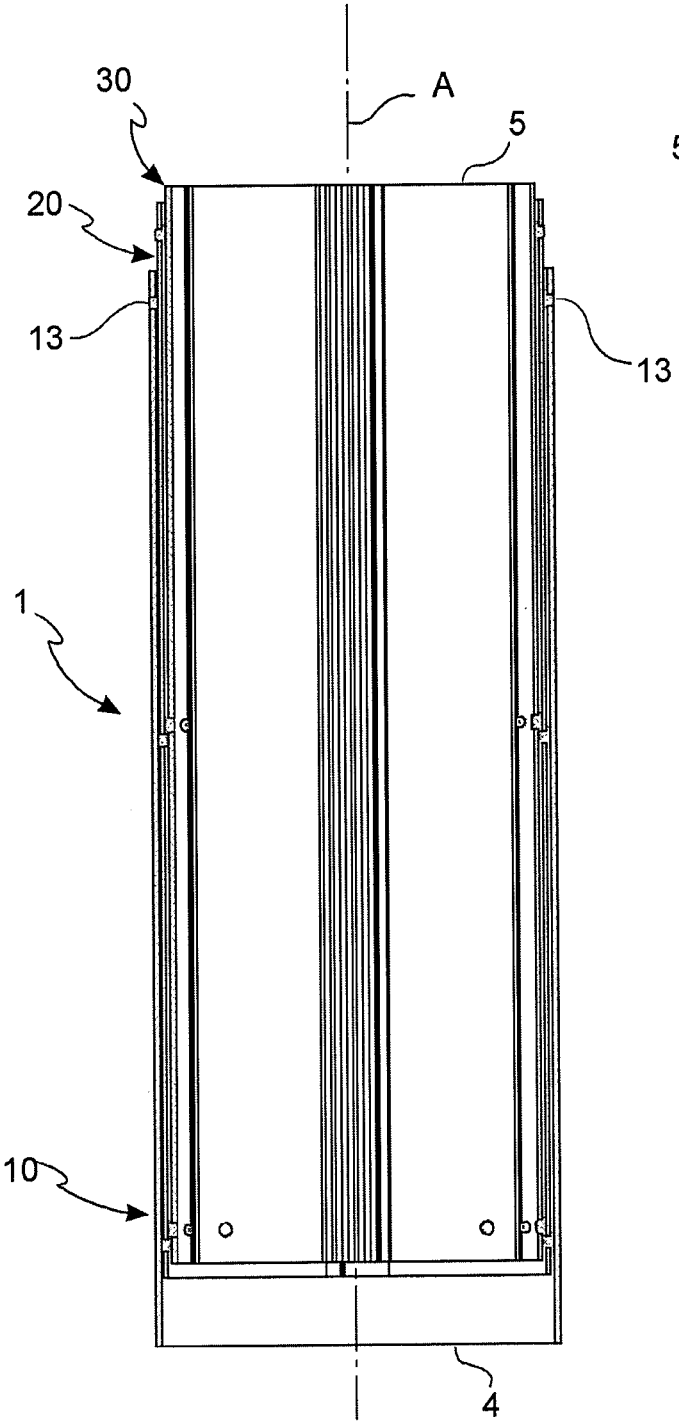
FIG. 12 shows a cross-section of the leg shown in FIG. 6, with a cross-section plane XII coinciding with the plane VI, in which the leg is in the retracted position.
Figure 13:
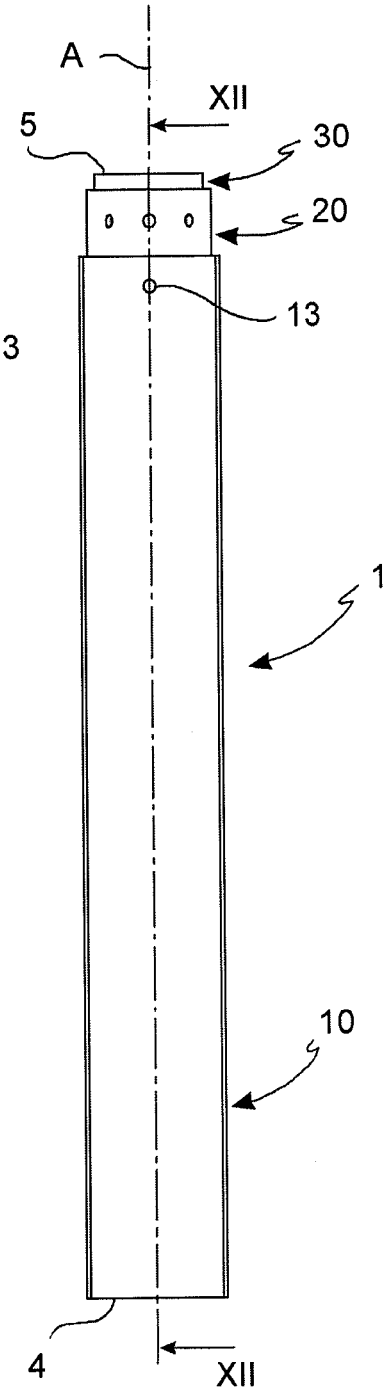
FIG. 13 shows a side view of the leg in FIG. 7, in which the leg is in the retracted position.
Figure 14:
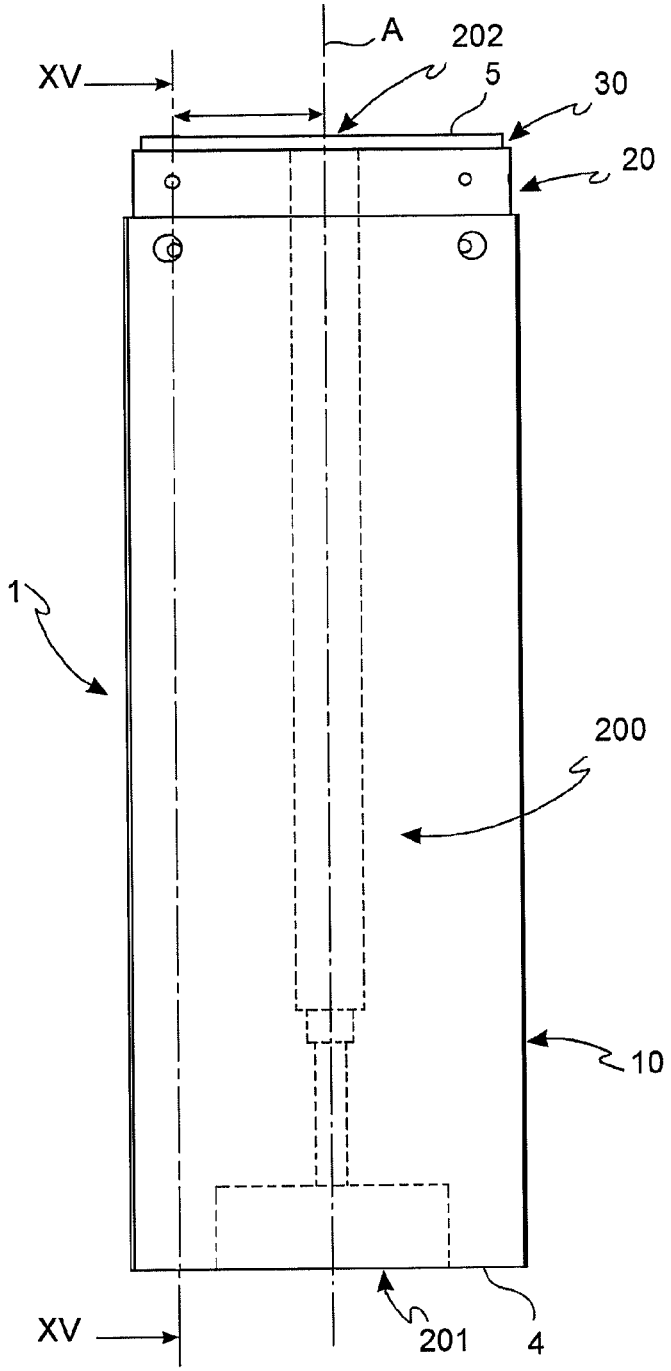
FIG. 14 shows a side view of the leg in FIG. 9, in which the leg is in the retracted position.
Figure 15:
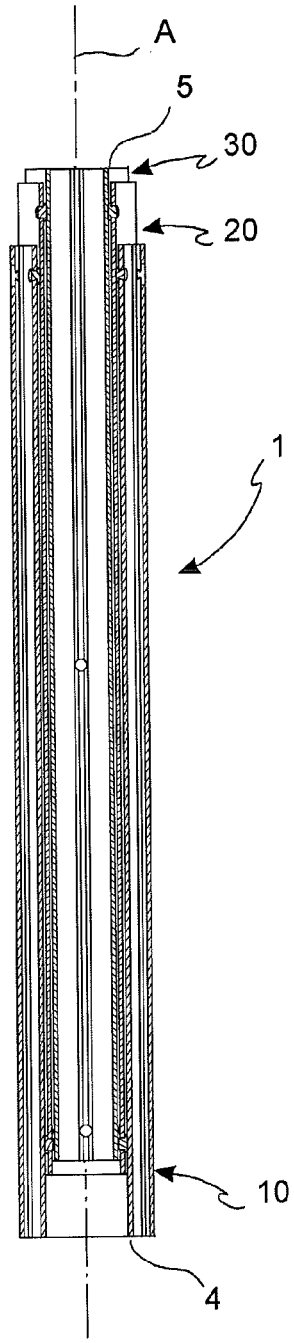
FIG. 15 shows the cross-section of FIG. 10, with a cross-section plane XV coinciding with the cross-section plane X.
Figure 27:
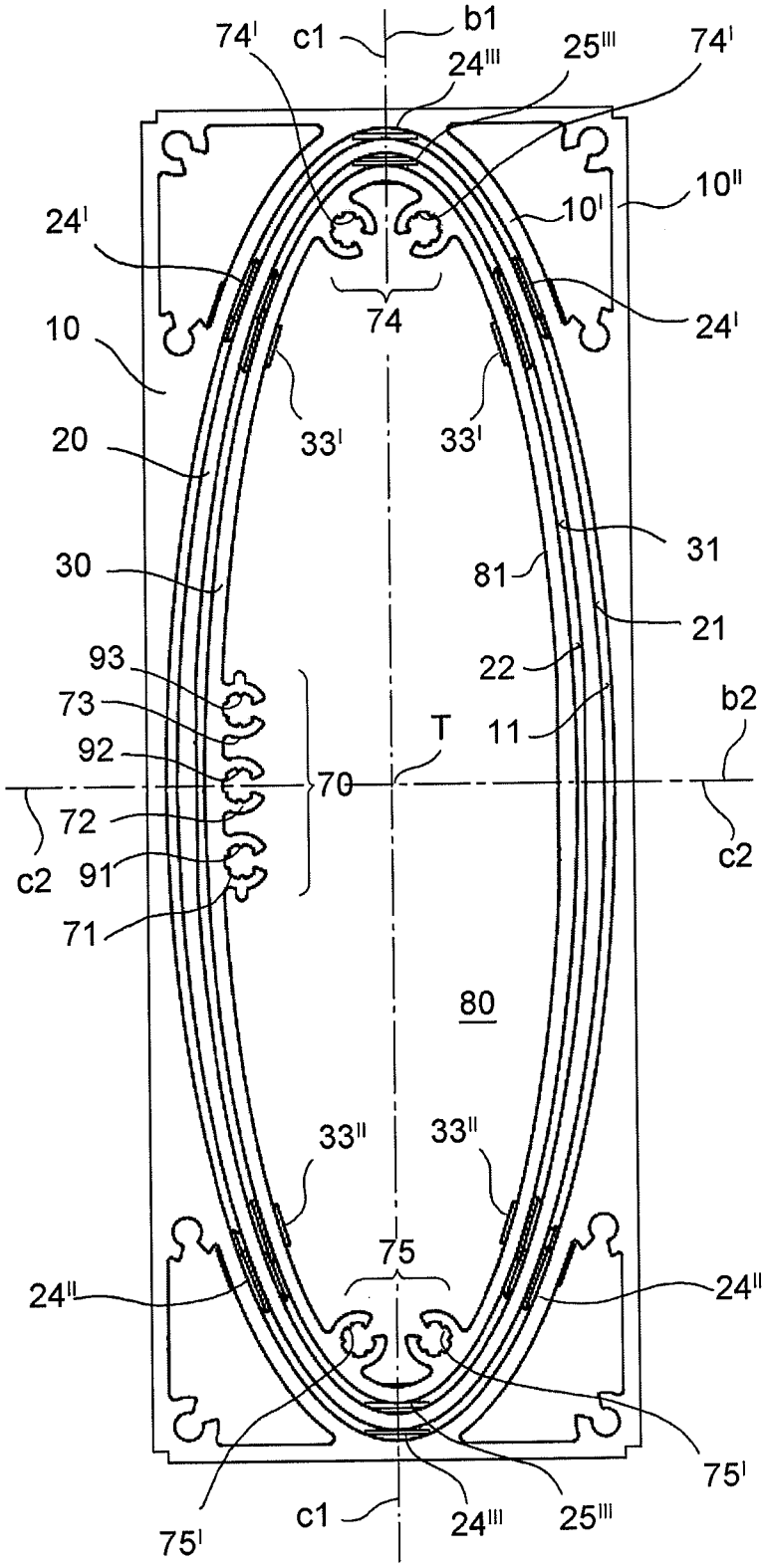
FIG. 27 shows a plan view, or along the extension axis, of the adjustable leg in FIG. 4, comprising the upper end leg member, a central leg member, a lower end leg member.
Figure 28:
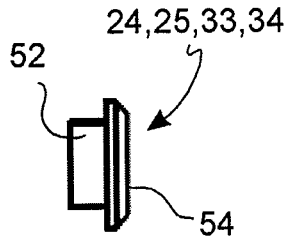
FIGS. 28 to 30 respectively show a side view and two perspective views of a pulling element for the adjustable leg according to the invention.
Figure 29:
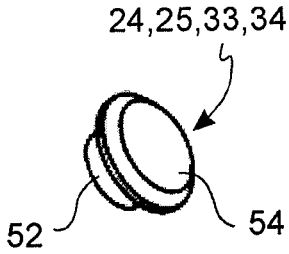
Figure 30:
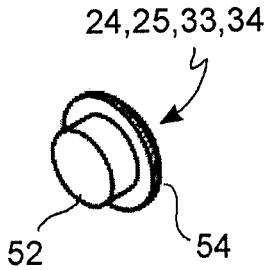

With reference to the figures, an adjustable leg for supporting a top, for example, the work top, or support surface of a table, according to the invention, is globally denoted by reference numeral 1.

The adjustable leg 1 extends along an extension axis A and is adjustable along said extension axis A, between a retracted or lowered position, in which the leg has minimum length, and an extended or raised position, wherein the leg has maximum length.

In the present description, the term "longitudinal" means a direction parallel, or substantially parallel, to the extension axis A.

The adjustable leg 1 is, therefore, a telescopically extendable leg.

The adjustable leg 1 has a first end 4 and a second end 5, opposite the first end.

The first end 4 is suitable to be directed towards a floor, for example, resting directly on the floor, or suitable to be secured to a support base 2. Such base 2 may therefore be rested on or secured to a floor, or to a wall.

The second end 5 is suitable to be fixed to a top 3, for example the work top of a table, in particular to an underside of a table top.

According to a preferred embodiment, the first end of the leg 1 is attached to a base 2, and the second end attached to the work top of a table. For example, the leg 1 is mounted with its extension axis A in the orthogonal direction with a support plane parallel to the floor of the base 2, for example, the adjustable leg 1 is vertical. According to other embodiments, the adjustable leg may be mounted in a direction angled with respect to the vertical direction, for example, so that its extension axis A is horizontal.

The adjustable leg comprises a plurality of members, in particular it comprises at least one base leg member that ends with the first end 4, and an upper leg member 30 which ends with the second end 5, wherein the base leg member 10 and the upper leg member 30 slide telescopically with each other along the extension axis A.

At least one leg member 10, 20, 30 of the plurality is defined by an outer surface 21, 31 extending around the extension axis A and at least another leg member 10, 20 is defined by an inner surface 12, 22 configured to slidably receive the outer surface of the at least one member along the extension axis A.

The inner surface 12, 22 of a leg member 10, 20, 30 is, therefore, configured to slidingly receive inside it the outer surface 21, 31 of a leg member 10, 20, 30 contiguous to the plurality of leg members, and the inner surface 12, 22 of a leg member is facing and complementary to the outer surface 21, 31 of a contiguous leg member 10, 20, 30.

The adjustable leg comprises contrast members 24, 25, 33, 34 interposed between the outer surface of the at least one leg member and the complementary inner surface of the at least another contiguous leg member, in elastic contrast against the other of said inner surface 12, 22 and the outer surface 21, 31 of a contiguous leg member 10,20,30;

Advantageously, the elasticity of the contrast members 24, 25, 33, 34 and the elasticity of the leg members 10, 20, 30 are dimensioned to form a forced coupling between the at least one leg member 20, 30 and the at least another contiguous leg member 10, 20, to generate a force of static friction between said leg members 10, 20, 30 in the direction parallel to the extension axis A of the leg, so that the static friction force contributes to reciprocally blocking at rest the leg members 10, 20, 30 and to counter an external force applied between the ends of the leg along the extension axis A.

According to one embodiment, the contrast members are made of a different material from the material of the leg members, for example plastic.

According to one embodiment, the contrast members are made of a material having a Young's modulus greater than the Young's modulus of the material of the leg members.

The contrast members 24, 25, 33, 34 project transversally to the inner 12, 22 or outer 21, 31 surfaces to which they are secured, along a length such as to form an interference coupling between contiguous leg members 10, 20, 30.

According to one embodiment, the plurality of leg members 10, 20, 30 comprises a base leg member 10 ending with a first end 4 of said leg 1 and an upper leg member 30 ending with a second end 5 of said leg 1.

For example the base leg member 10 is extruded, for example extruded aluminium or aluminium alloy.

The base leg member 10 has an inner surface 12 which extends around the extension axis for the entire length of the base leg member 10. In other words, the inner surface 12 forms a longitudinal through cavity.

According to a possible embodiment, the transversal cross-section of the inner surface 12 of the base leg member 10 with respect to the extension axis A is a closed line. In other words the base leg member 10 may be a tubular element.

According to a possible embodiment, the upper leg member 30 is extruded, for example extruded aluminium or aluminium alloy.

The upper leg member 30 is delimited by an outer surface 31 which extends for the entire length of said upper leg member.

According to this embodiment, the upper leg member 30 is configured to slide inside the inner surface 12 of the base leg member 10, and is coupled with such portion of the base leg member by contrast members. In other words, the upper leg member is coupled to the base leg member 10 by means of contrast members, avoiding the use of sliding guides or guides with rolling members.

According to one embodiment, the adjustable leg 1 further comprises at least one intermediate member 20 slidingly interposed between the base leg member 10 and the upper leg member 30.

Such at least one intermediate member 20 can be slidingly constrained to the base leg member 10 and the upper leg member 30 by means of the contrast members 24, 25, 33, 34.

In other words, the at least one intermediate member 20 is coupled to the upper leg member 30 and to the base leg member 10, avoiding the use of sliding guides or guides with rolling members.

Thus, according to this embodiment, the at least one intermediate member 20 is supported in its position, exclusively by means of the contrast members 24, 25, 33, 34.

In other words, the at least one intermediate member 20 is supported in its position and pulled during the relative movement between the upper leg member 30 and the base leg member 10, avoiding the use of means of movement or retention.

Thus, the at least one intermediate member 20 is pulled in its movement exclusively by the contrast members, by friction, avoiding being moved by movement mechanisms.

According to one embodiment, the at least one intermediate leg member 20 is extruded, for example extruded aluminium or aluminium alloy.

According to one embodiment, the at least one intermediate member 20 is externally delimited by an outer surface 21 and internally by an inner surface 22.

The outer surface 21 and the inner surface 22 are parallel and coaxial to each other and extend for the entire length of the intermediate member.

In other words, the at least one intermediate member 20 is a tubular element.

According to one embodiment, the outer surface 21 of each intermediate leg member 20 is complementary to the inner surface of a next contiguous intermediate leg member or to the inner surface 12 of the base leg member 10, and the inner surface 22 of said each intermediate leg member 20 is complementary to the outer surface 31 of a previous contiguous leg member or to the outer surface 31 of upper leg member 30.

In particular, a contiguous intermediate leg member is prior to or next to an intermediate leg member 20, depending on whether it is located before or after the intermediate leg member 20 in the direction that goes from the first end 4 of the leg to the second end 5 of the leg, when the leg is in the extended position.

According to one embodiment, the at least one intermediate member 20 is a single intermediate member 20.

In other words, according to a preferred embodiment, the leg 10 comprises a base leg member 10, an upper leg member 30 and a single interposed intermediate member 20.

The outer surface 21 of the intermediate member 20 is complementary to the inner surface 12 of the base leg member 10, and the inner surface 22 of the intermediate member 20 is complementary to the outer surface 31 of the upper leg member 30.

According to one embodiment, the upper leg member 30 is slidable inside the intermediate member 20, said intermediate member 20 being slidable inside the base member 10.

According to one embodiment, a first plurality 34, 25 of said contrast members is mounted in a projecting manner from said outer surface 21, 31 of said at least one leg member 20, 30, along at least one first distribution plane D' substantially orthogonal to the extension axis A, for example in the proximity of an end 28, 38 of said leg member 20, 30, for example a lower end.

According to one embodiment, a second plurality 33, 24 of said contrast members is mounted in a projecting manner from said outer surface 21, 31 of said at least one leg member 10, 20, along at least one second distribution plane D" substantially orthogonal to the extension axis A, thus substantially parallel to D', and distanced from the first distribution plane D'. In other words, the second distribution plane D" is in a substantially central position with respect to the length of the leg member 10, 20 in the extension direction A.

In a different embodiment, the position of the plurality of contrast members may be reversed, in the sense that the first plurality 34, 25 of said contrast members can be mounted to protrude from said inner surface 12, 22 of said at least one leg member 20, 30, and also the second plurality of contrast members 24, 33 may be mounted to protrude from said inner surface 12, 22 of said at least one leg member 20, 30.

The contrast members 24, 25, 33, 34 are distributed along the respective distribution planes D' and D" so as to balance overall the pressure forces transversal to the extension axis A generated by the interaction between a leg member 10, 20, 30, and an adjacent leg member and the contrast members, so as to align and guide a leg member 20, 30 inside the inner surface 12, 22 of an adjacent leg member 20, 10, in particular avoiding any further sliding contact between adjacent leg members.

According to one embodiment, the first plurality of contrast members 34, 25 is distributed in pairs of opposite members, arranged mutually aligned so as to generate mutually aligned and opposite contrast forces, transversal to the extension axis A.

According to one embodiment, the second plurality of contrast members 33, 24 is distributed in pairs of opposite members, arranged mutually aligned so as to generate mutually aligned and opposite contrast forces, transversal to the extension axis (A).

According to a possible embodiment, each contrast member of the first plurality 25, 34 is aligned with a respective contrast member of the second plurality 24, 33 of the same leg element 20, 30, in a direction parallel to the extension axis. This entails the advantage of guiding the sliding of adjacent leg members avoiding angular displacements with respect to the extension axis.

According to one embodiment, the leg according to the invention comprises end-stroke members for limiting the relative sliding between the leg members at the limit position of the fully extended leg and fully retracted leg.

For example, such end-stroke members are projecting abutment members 13, 23.

According to one embodiment, such projecting abutment members 13, 23 are obtained by means of further contrast members.

According to an embodiment, the contrast members 24, 25, 34, 33 comprise an engagement portion 52 suitable to engage in a corresponding hole 53 in a respective leg member 10, 20, 30, for example a through hole.

The contrast members 24, 25, 34, 33, also comprise a contact surface 54, opposite the engagement portion 52, suitable to make sliding contact with a facing inner or outer surface of a contiguous leg member.

According to a preferred embodiment, the cross-section with a section plane XVI, XVII, XX, XXI, XXIV transversal to the extension axis A, of said inner 12, 22 and outer surfaces 21, 31, is an ellipse having a major axis b1 and a minor axis b2.

In other words, according to this embodiment, the outer surface 21, 31 is an extruded surface with an elliptical transversal cross section, for example which extends with continuity of shape, for example without interruptions of the shape. Furthermore, the inner surface 12, 22 can be an extruded surface with a transversal, elliptical cross-section, for example which extends with continuity of shape, for example without interruption of the shape.

For example, the first plurality of contrast members 25, 34 comprises a first pair of contrast members 25', 34' and a second pair of contrast members 25", 34" arranged peripherally with respect to the major axis b1 of the ellipse, particularly, in a symmetrical manner with respect to the minor axis b2.

Similarly, the second plurality 24, 33 of contrast members comprises a first pair of contrast members 24', 33' and a second pair of contrast members 24", 33" arranged peripherally with respect to the major axis b1 of the ellipse, particularly, in a symmetrical manner with respect to the minor axis b2.

Furthermore, the first plurality 25, 34 of contrast members comprises a third pair of contrast members 25''', 34''' arranged at the opposite ends of the major axis b1.

Furthermore, the second plurality 24, 33 of contrast members comprises a third pair of contrast members 24''', 33''' arranged at the opposite ends of the major axis b1.

In other words, in the case of the leg with a transversal elliptical cross-section, as shown for example in FIGS. 1-27, the contrast members are concentrated in the vicinity of the lateral ends of the leg members 20, 30 along the major axis b1, leaving the central area interposed between said side portions free.

This has the advantage of loading only those lateral portions, by means of the contrast forces exerted by the contrast members which are more resistant mechanically, leaving the central portions of the transversal cross-section of the leg members 20, 30, which are less resistant to compression, unloaded.

This particular distribution of the contrast members thus makes it possible to obtain an optimal distribution of the of contrast forces along the outer and inner surfaces of the leg members.

Among other things, such a distribution of the contrast members, associated with the elliptical shape of the transversal cross-section of the leg members, makes it possible to prevent the relative rotation of the leg members 10, 20, 30 with respect to the extension axis A, avoiding the need for shoulders or projections from the outer or inner surfaces.

Figure 31:
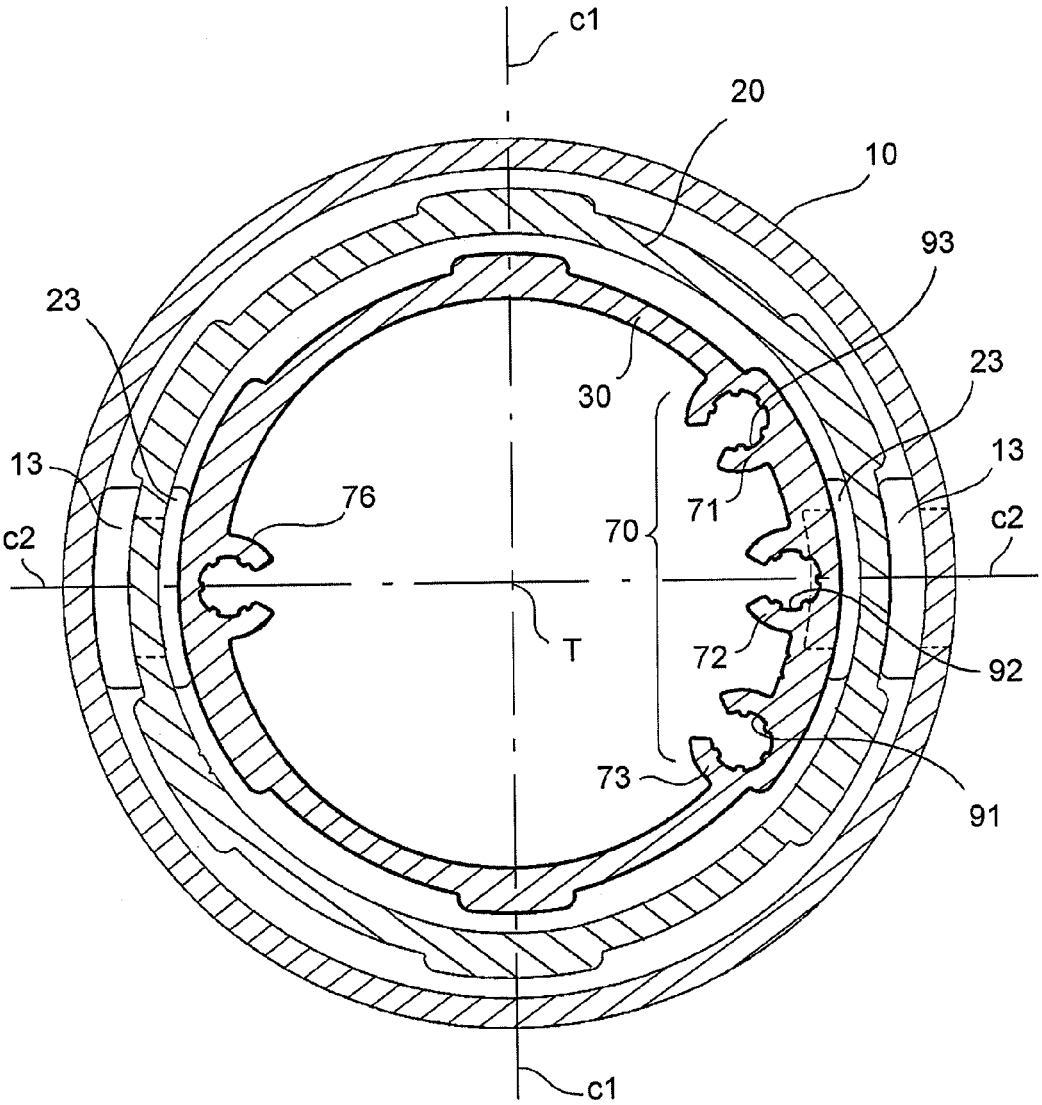
FIG. 31 shows a plan view of a further embodiment of the adjustable leg according to the present invention, in which the leg has a circular transversal cross-section.

According to another embodiment, the leg members 10, 20, 30 may have a substantially circular cross-section transversal to the extension axis, as shown in FIG. 31.

According to another aspect of the invention, the aforesaid purposes and advantages are achieved by a table comprising a support top 3, and at least one adjustable leg 1 as described in this description, wherein the adjustable leg 1 has a first end 4 suitable to be rested on a floor, or secured to a support base 2, and a second end 5, opposite the first end 4, secured to said support top 3 to support said top 3 at an adjustable height from the floor.

According to one embodiment, at least one leg member 30 of the plurality of leg members 10, 20, 30 is an extruded tubular member delimited internally by an inner surface of the tubular member 81, wherein said tubular member 30 extends along a central axis T of the tubular member 30, for example, substantially parallel to the extension axis.

According to one embodiment, the at least one leg member 30 comprises a plurality of longitudinal reinforcing ribs 70, 74, 75 extending throughout the entire length of said tubular member 30, said longitudinal ribs projecting from said tubular member inner wall 81 towards the inside 80 of the tubular member 30.

According to one embodiment, the ribs of the plurality of ribs 70, 74, 75, 76 are distributed along the inner surface 81 of the tubular member asymmetrically with respect to a first longitudinal plane C1 passing through the central axis T, and symmetrically with respect to a second longitudinal plane C2 passing through the central axis T and orthogonal to the first longitudinal plane C1.

According to one embodiment, the plurality of ribs, 70 74, 75, 76 comprise a bundle 70 of ribs close together and close to the second longitudinal plane C2, arranged on one side only in relation to the first plane C1.

According to one embodiment, the ribs 71, 72, 73 of the bundle 70 of ribs are equidistant. For example, the bundle 70 of ribs is formed by an odd number of parallel ribs, with the central rib arranged along the second longitudinal plane C2, for example such bundle 70 is made of three ribs 71, 72, 73, wherein the central rib 72 is arranged along the second plane C2.

According to one embodiment of the adjustable or telescopic leg, the plurality of ribs 70, 74, 75, 76 comprises at least one opposite rib 76 positioned in the vicinity of the second longitudinal plane C2 on the side opposite the bundle 70 of ribs with respect to the first longitudinal plane C1, wherein the bundle 70 of ribs comprises a number of ribs 71, 72, 73 greater than the number of ribs of said at least one opposite rib 76. In other words, the bundle 70 is formed of a greater number of ribs than the number of the opposite ribs 76. This serves to reinforce the tubular member 30 only on the side opposite to the direction of projection of the table, where the leg is most stressed in traction.

According to one embodiment, the plurality of ribs 70, 74, 75, 76 includes two second groups of ribs 74, 75, in particular substantially equal to each other, positioned in the vicinity of the first longitudinal plane C1 and on opposite sides of the second longitudinal plane C2.

According to one embodiment, each rib 71, 72, 73 of the bundle 70 of ribs comprises a longitudinal channel 81, 82, 83, in particular open towards the inside 80 of the tubular member 30, suitable to receive and retain in the longitudinal direction a fixing screw, in particular for securing a support surface 3 of a table to said tubular member 30.

According to one embodiment, all the ribs of the plurality of ribs 70, 74, 75, 76 are substantially equal to each other.

According to an embodiment, the cross-section of the tubular member 30, orthogonally to the central axis T, is an elliptical cross-section having a major axis b2 and a minor axis b1, wherein the major axis b1 belongs to the first longitudinal plane C1 and wherein the minor axis b2 belongs to the second longitudinal plane C2.

According to one embodiment, the cross-section of the tubular member 30, orthogonally to the central axis T, is a substantially circular cross-section.

According to one embodiment, at least one leg member 10 of the plurality of leg members 10, 20, 30 is an extruded member comprising an inner tubular portion 10' with an elliptical transversal cross-section contained and enclosed in an outer tubular portion 10" with a rectangular transversal cross-section, wherein each side of said portion with a rectangular cross-section 10" is centrally joined to said portion of elliptical cross-section 10'.

According to an embodiment, the tubular member 30 is the upper leg member and the extruded member 10 is the lower or base leg member.

According to another aspect of the invention, the above aims and advantages are satisfied by a table comprising a support surface 3, and at least one adjustable or telescopic leg 1 as described above, wherein said adjustable leg 1 has a first end 4 suitable to be rested on a floor, or secured to a support base 2, and a second end 5, opposite the first end 4, secured to said support top 3 to support said support top 3 at an adjustable height from the floor, wherein the second end of said at least one adjustable leg 1 is secured to the support surface 3 near a peripheral edge 3' of the support surface 3 and so that the bundle of ribs 70 is positioned towards the outside of the support top 3.

According to one embodiment, the adjustable or telescopic leg 1 comprises a linear actuator 200, extensible between a minimum length and a maximum length, in particular contained and concealed inside the leg 1.

Said linear actuator 200 has a first end 201 secured to the lower leg or base member 10, and a second end 202, opposite the first end 201, secured to the upper end leg member 30, so that when the actuator 200 lengthens, the leg 1 also lengthens, and when the actuator 200 shortens, the leg 1 also shortens.

For example, the first end 201 of the actuator 200 is secured to the first end 4 of the leg, and the second end of the actuator 200 is secured to the second end of the leg 1.

According to one embodiment, the actuator 200 comprises a motor, for example an electric motor, and a screw-and-nut system.

Alternatively a pneumatic or hydraulic linear actuator may be used.

A person skilled in the art may make modifications and adaptations to the embodiments of the device described above, replacing elements with others functionally equivalent so as to satisfy contingent requirements while remaining within the sphere of protection of the following claims. Each of the characteristics described as belonging to a possible embodiment may be realised independently of the other embodiments described.

The invention claimed is:

1. An adjustable leg for supporting a support top of a table, said leg defining an extension axis, a first end of the leg, and a second end of the leg, opposite the first end, comprising:

a plurality of leg members mutually slidably engaged along the extension axis;

wherein at least one leg member of said plurality is defined by an outer surface extending about the extension axis and at least another leg member contiguous to the one leg member is defined by an inner surface configured to slidably receive said outer surface of the at least one leg member along the extension axis;

wherein said inner surface of said at least another member contiguous faces and is complementary to said outer surface of said at least one member;

wherein said inner surface and said outer surface is an extruded surface with an elliptical section, having a major axis and a minor axis;

contrast members interposed between the outer surface of said at least one leg member and the complementary inner surface of said at least another contiguous leg member, by elastic contrast between said outer surface and said inner surface, said contrast members comprising a first pair of contrast members and a second pair of contrast members arranged in the vicinity of the ends of the leg members along the major axis of the ellipse, in a symmetrical manner with respect to the minor axis, leaving central portions of the transversal cross-section of the leg members unloaded;

wherein the elasticity of said contrast members and the elasticity of said leg members are designed to form a forced frictional coupling between said at least one leg member and said at least another contiguous leg member in a direction parallel to the extension axis of the leg so that said static friction force opposes a force applied to the second leg end towards the first leg end along the extension axis and locks in rest the leg members to one another so to prevent relative movement between the first leg end and second leg end in the direction parallel to the extension axis of the leg.

2. The adjustable leg according to claim 1, wherein the contrast members project transversally to the inner or outer surfaces to which they are secured, along such a length as to form an interference coupling between contiguous leg members.

3. The adjustable leg according to claim 1, wherein a first plurality of said contrast members is mounted in a projecting manner from said outer surface of said at least one leg member, along at least one first distribution plane substantially orthogonal to the extension axis in the proximity of an end of said leg member.

4. The adjustable leg according to claim 3, wherein a second plurality of said contrast members is mounted in a projecting manner from said outer surface of said at least one leg member, along at least one second distribution plane substantially orthogonal to the extension axis and substantially parallel to the first distribution plane, wherein the second distribution plane is spaced from the first distribution plane.

5. The adjustable leg according to claim 1, wherein the first plurality of contrast members is distributed in pairs of mutually opposite members, arranged mutually aligned so as to generate mutually aligned and opposite contrast forces, substantially transversal to the extension axis, and/or wherein the second plurality of contrast members is distributed in pairs of opposite members, arranged mutually aligned so as to generate mutually aligned and opposite contrast forces, transversal to the extension axis.

6. The adjustable leg according to claim 5, wherein said second plurality of contrast members comprises a first pair of contrast members and a second pair of contrast members arranged peripherally with respect to the major axis of the ellipse, particularly, in a symmetrical manner with respect of the elliptical section, particularly, in a symmetrical manner with respect to the minor axis.

7. The adjustable leg according to claim 1, comprising end-stroke members to limit the relative sliding between the leg members at a completely withdrawn leg position and a completely retracted leg position, wherein such end-stroke members are abutting projecting members, and wherein such end-stroke members are formed by further contrast members.

8. The adjustable leg according to claim 1, wherein at least one leg member of said plurality of leg members is an extruded tubular member internally defined by a tubular member inner surface, said tubular member extending along a central axis of tubular member, wherein said at least one leg member comprises a plurality of longitudinal reinforcing ribs extending throughout the entire length of said tubular member, said longitudinal ribs projecting from said tubular member inner wall towards the inside of the tubular member;

wherein the ribs of said plurality of ribs are distributed along the tubular member inner surface asymmetrically with respect to a first longitudinal plane passing through the central axis, and symmetrically with respect to a second longitudinal plane passing through the central axis and orthogonal to the first longitudinal plane.

9. A table comprising a support top and at least one adjustable leg for supporting said support top at an adjustable height from the floor, said leg defining an extension axis, a first end of the leg, and a second end of the leg, opposite the first end, said leg comprising:

a plurality of leg members mutually slidably engaged along the extension axis;

wherein at least one leg member of said plurality is defined by an outer surface extending about the extension axis and at least another leg member contiguous is defined by an inner surface configured to slidably receive said outer surface of the at least one member along the extension axis;

wherein said inner surface of said at least another member contiguous faces and is complementary to said outer surface of said at least one member;

wherein said inner surface and said outer surface is an extruded surface with an elliptical section, having a major axis and a minor axis;

contrast members interposed between the outer surface of said at least one leg member and the complementary inner surface of said at least another contiguous leg member, by elastic contrast between said outer surface and said inner surface, said contrast members comprising a first pair of contrast members and a second pair of contrast members arranged in the vicinity of the ends of the leg members along the major axis of the ellipse, in a symmetrical manner with respect to the minor axis, leaving central portions of the transversal cross-section of the leg members unloaded;

wherein the elasticity of said contrast members and the elasticity of said leg members are designed to form a forced frictional coupling between said at least one leg member and said at least another contiguous leg member in a direction parallel to the extension axis of the leg so that said static friction force opposes a force applied to the second leg end towards the first leg end along the extension axis and concurs to lock in rest the leg members to one another so to prevent relative movement between the first leg end and second leg end in the direction parallel to the extension axis of the leg.

* * * * *